US008327940B2

(12) United States Patent
Boronin et al.

(10) Patent No.: US 8,327,940 B2
(45) Date of Patent: Dec. 11, 2012

(54) METHOD FOR HYDRAULIC FRACTURING OF A LOW PERMEABILITY SUBTERRANEAN FORMATION

(75) Inventors: Sergey Andreevich Boronin, Moscow (RU); Andrey Aleksandrovich Osiptosov, Moscow (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 24 days.

(21) Appl. No.: 13/124,193

(22) PCT Filed: Sep. 30, 2009

(86) PCT No.: PCT/RU2009/000503

§ 371 (c)(1),
(2), (4) Date: Jul. 25, 2011

(87) PCT Pub. No.: WO2010/044697

PCT Pub. Date: Apr. 22, 2010

(65) Prior Publication Data

US 2011/0265998 A1 Nov. 3, 2011

(30) Foreign Application Priority Data

Oct. 14, 2008 (RU) ..... 2008140628

(51) Int. Cl.
*E21B 43/26* (2006.01)

(52) U.S. Cl. ..... 166/308.1

(58) Field of Classification Search ..... None
See application file for complete search history.

(56) References Cited

U.S. PATENT DOCUMENTS

| | | | | |
|---|---|---|---|---|
| 6,776,235 | B1 | 8/2004 | England | |
| 7,004,255 | B2 * | 2/2006 | Boney | 166/280.2 |
| 7,228,904 | B2 * | 6/2007 | Todd et al. | 166/280.2 |
| 7,302,849 | B2 | 12/2007 | Segal et al. | |
| 2004/0020649 | A1 | 2/2004 | Fields | |
| 2004/0168801 | A1 * | 9/2004 | Reddy et al. | 166/292 |
| 2007/0209795 | A1 * | 9/2007 | Gupta | 166/278 |
| 2008/0032898 | A1 * | 2/2008 | Brannon et al. | 507/100 |

FOREIGN PATENT DOCUMENTS

| | | | |
|---|---|---|---|
| RU | 2173821 | C1 | 9/2001 |
| RU | 2283945 | C1 | 9/2006 |
| RU | 2298650 | C1 | 5/2007 |
| RU | 2309971 | C1 | 11/2007 |
| WO | 2007086771 | A1 | 8/2007 |

OTHER PUBLICATIONS

International Search Report of PCT Application Serial No. PCT/RU2009/000503 dated Feb. 25, 2010.

* cited by examiner

*Primary Examiner* — Terry Lee Melius
*Assistant Examiner* — Silvana Runyan

(57) ABSTRACT

A fracturing fluid containing proppant particles is injected into a fracture made in a low-permeability subterranean formation, providing a turbulent flow of the fluid in the fracture during injection. This allow to increase a fracture conductivity after its closure by means of preventing transverse migration of proppant particles within the fracture and the reduction of their setting rate.

3 Claims, No Drawings

METHOD FOR HYDRAULIC FRACTURING OF A LOW PERMEABILITY SUBTERRANEAN FORMATION

FIELD OF THE INVENTION

The present invention is related to hydraulic fracturing in low permeability subterranean formations and can be applied, in particular, at oil and gas fields.

BACKGROUND OF THE INVENTION

Hydraulic fracturing is the main operating process to increase permeability of productive formation near-wellbore area by means of fracturing or due to expansion and deepening of natural fractures existing in the formation. For this purpose, a fracturing fluid is injected under high pressure into the wellbore passing through the subterranean formation. Deposit in the formation or rock deposit is forced to cracking and fracturing. The propping agent (proppant) is injected into the fracture to prevent fracture closing after formation depressurization and, thereby, to provide improved extraction of extractive fluids, that is oil, gas or water.

Thus, the proppant is used to keep the distance between the fracture walls in order to create conductive channel in the formation towards the wellbore. In addition to the transportation of proppant particles along the fracture there is also transverse migration of particles causing concentrated vertical layer in the middle of the fracture. This phenomenon results in the substantial increase of particles setting rate, that in its turn leads to the reduction of fracture conductivity after its closing. To settle this issue a wide range of techniques based on various physical mechanisms was suggested.

Patent WO2007086771 provides for hydraulic fracturing methods which ensure improvement of fracture conductivity because of forming strong proppant clusters, uniformly placed in the fracture through its length. One of these methods comprises: a first stage that involves injection into a borehole of a fracturing fluid containing thickeners to create a fracture in the formation; and a second stage that involves periodic introduction of proppant into the injected fracturing fluid to supply the proppant into a created fracture, to form proppant clusters within the fracture to prevent fracture closure and channels for flowing formation fluids between the clusters, wherein the second stage or its sub-stages involve additional introduction of either a reinforcing or consolidation material or both, thus increasing the strength of the proppant clusters formed into the fracture fluid. uniformly placed in the fracture through its length.

U.S. Pat. No. 7,228,904 relates to enhancing the conductivity of fractures in a subterranean formation by consolidation of a special proppant matrix. Composition particles at certain concentration are proposed to be added into the fracturing fluid along with common (filler) proppant particles in order to form strong matrix, which will not be crushed during the process of fracture closure.

U.S. Pat. No. 7,004,255 suggested methods for plugging of natural or artificially-created fractures in subterranean formations to reduce the flow of fluids. The compositions are mixtures of primarily inert particles of different sizes that leave a minimal flow path for fluids when the particles are packed in the fracture. If the fracture can close on the particles, the particles need not fill the width of the fracture before closure to cause plugging.

US Patent application 20040206497 suggests a method for enhancing the production of hydrocarbons from a subterranean formation. A hydrocarbon bearing formation, surrounding a well bore, is fractured with a fracturing fluid to create one or more fractures in the formation. The formation includes a higher permeability zone and a lower permeability zone with the fractures extending across both the higher and lower permeability zones. The lower permeability zone may contain a substantially higher concentration of hydrocarbons, oil and gas, than does the higher permeability zone which may generally be depleted of hydrocarbons. Proppant is then selectively positioned in the fractures using a carrier fluid with a majority of the proppant being positioned in the lower permeability zone. The fracture is allowed to close about the proppant to create at least one high conductivity channel in the lower permeability zone. Through the use of this method, the overall productivity of the lower permeability zone is increased relative to the overall productivity of the higher permeability zone thus enhancing the production of hydrocarbons from the hydrocarbon bearing formation. The selectively positioning of the proppant may occur in a single stage where proppant is allowed to "float" in the carrier fluid to the top of the fracture. Alternatively, in a dual stage proppant placement a viscous fracturing fluid can have a less dense proppant laden carrier fluid injected on top thereof in the lower permeability, higher hydrocarbon concentration zone.

US20070209795 proposed lightweight polyamide particulates to be used in treatment of subterranean formations, including hydraulic fracturing and sand control methods, such as gravel packing. The polyamide particulates typically have an apparent specific gravity (ASG) between from about 1.05 to about 2.0 and are stable at temperatures up to 500° C. The polyamide particulates may be used in combination with a filler which further serves to increase the strength and temperature stability of the resulting composite. Fracture conductivity may be increased by the placement of the low density polyamide particulates as a partial monolayer.

US 20080032898 deals with the increase of the fracture conductivity by significantly (up to 100%) increase in the propped length. This is proposed to achieve by introducing into the formation one or more proppant stages wherein at least one of the proppant stages contains an ultra lightweight (ULW) proppant. The first proppant stage may consist of a mixture of proppants, at least one of which is an ULW proppant. Alternatively, sequential proppant stages may be introduced into the formation wherein at least one of the proppant stages contains an ULW proppant.

All above mentioned patents suggest reduction methods for particles setting rate in the fracture by using lighter particles; however none of the inventions allow avoiding transverse migration of particles which happens at laminar flow.

SUMMARY OF THE INVENTION

The result of the present invention is the increase of fracture conductivity after its closing by means of preventing transverse migration of proppant particles within the fracture and the reduction of their setting rate by achieving turbulent flow within the fracture.

This result is achieved by injecting a fracturing fluid containing proppant particles into a fracture made in a low-permeability subterranean formation, providing a turbulent flow of the fluid in the fracture during injection.

The turbulent flow is provided by injecting a fracturing fluid with viscosity less than 0.01 Pa·s and pumping rate exceeding 8 $m^3$/min, where the fluid contains proppant particles with the radius σ, which is determined by the formula $$\sigma < 0.02w\sqrt{\frac{\rho_f}{\rho_p}}$$

if proppant particles are heavier than the fluid ($\rho_p > \rho_f$), or by the formula $$\sigma > 0.03w\sqrt{\frac{\rho_f}{\rho_p}}$$

if proppant particles are lighter than the fluid ($\rho_p < \rho_f$), where w represents the fracture width, $\rho_f$ and $\rho_p$ represent densities of the fluid and proppant.

A low-viscosity fracturing fluid containing no proppant can be previously injected into the wellbore to open and expand the fracture.

Besides, a special fracturing fluid comprising a proppant with rubber sheath can be injected into the wellbore which prevents proppant flow back into the wellbore during and after the fracture closure.

DETAILED DESCRIPTION OF THE PREFERRED EMBODIMENTS

Under the above conditions the turbulent flow is provided in the fracture, as confirmed by the theoretical studies of proppant effect on a flow stability in a hydraulic fracture. Large-scale vortices caused by turbulence act to re-suspend particles so that their distribution across the fracture gets more uniform, which finally prevents the formation of a proppant sheet near the channel centerline and hence reduces the proppant settling rate.

Hydraulic fracturing process can comprise three stages of different liquids injection into the subterranean formation: (1) injecting a low-viscosity fluid containing no proppant particles in a wellbore to open and propagate a hydraulic fracture in the subterranean formation; (2) injecting a fluid containing particles with special characteristics; and (3) injecting a special fracturing fluid comprising a proppant with rubber sheath which prevents proppant flow back into the wellbore during the fracture closure and after it.

Depending on density and size of particles substance there are several cases to comply with the above requirements and provide turbulent flow within the fracture. Let us suppose that the crack width w is equal to 1 cm. Then the particle size and density can be as follows: (1) small and heavy proppant particles (radius σ<0.1 mm and substance density $\rho_p$>3000 kg/$m^3$ or radius σ<0.2 mm and substance density $\rho_p$>1000 kg/$m^3$); (2) large and ultralight proppant particles (radius σ>0.5 mm and substance density $\rho_p$<1000 kg/$m^3$).

It is possible to use particles made of any material which is applied as a rule in the oilfield industry as a propping agent, for example, sand, ceramic particles, polymer pellets, glass particles etc. As low viscosity liquid it is possible to use water or water solution of polymer, as well as any other low viscosity liquid which is usually applied at the hydraulic fracture.

What is claimed is:

1. A method for hydraulic fracturing of a low-permeability subterranean formation comprising injecting a fracturing fluid with a pumping rate exceeding 8 $m^3$/min through a wellbore into a fracture made in the subterranean formation, the fracturing fluid having viscosity less than 0.01 Pa·s and containing proppant particles with the radius σ, which is determined by formula $$\sigma < 0.0173w\sqrt{\frac{\rho_f}{\rho_p}}$$

if proppant particles are heavier than the fracturing fluid ($\rho_p > \rho_f$), or by formula $$\sigma > 0.0387w\sqrt{\frac{\rho_f}{\rho_p}}$$

if proppant particles are lighter than the fracturing fluid ($\rho_p < \rho_f$), where w is the fracture width, $\rho_f$ and $\rho_p$—densities of the fluid and proppant.

2. The method of claim 1 wherein a low viscosity fracturing fluid containing no proppant is previously injected into the wellbore.

3. The method of claim 1 wherein after injecting the fracturing fluid with proppant particles a special fracturing fluid comprising a proppant with rubber sheath is injected into the fracture.

* * * * *

UNITED STATES PATENT AND TRADEMARK OFFICE

CERTIFICATE OF CORRECTION

PATENT NO. : 8,327,940 B2
APPLICATION NO. : 13/124193
DATED : December 11, 2012
INVENTOR(S) : Boronin et al.

It is certified that error appears in the above-identified patent and that said Letters Patent is hereby corrected as shown below:

Title Page, Item (75) Inventor is corrected to read:
-- Sergey Andreevich Boronin, Moscow (RU);
Andrei Aleksandrovich Osiptosov, Moscow (RU) --.

Signed and Sealed this
Eighth Day of December, 2015

Michelle K. Lee

Michelle K. Lee
*Director of the United States Patent and Trademark Office*